US006460317B1

(12) United States Patent
Voss

(10) Patent No.: US 6,460,317 B1
(45) Date of Patent: Oct. 8, 2002

(54) DEVICE FOR MANUFACTURING AND PREFERABLY ALSO FOR FILLING AND SEALING THERMOPLASTIC SACKS

(75) Inventor: Hans-Ludwig Voss, Tecklenburg (DE)

(73) Assignee: Windmöller & Hölscher, Lengerich (DE)

( * ) Notice: Subject to any disclaimer, the term of this patent is extended or adjusted under 35 U.S.C. 154(b) by 0 days.

(21) Appl. No.: 09/564,554

(22) Filed: May 4, 2000

(30) Foreign Application Priority Data

May 4, 1999 (DE) ..... 199 20 478

(51) Int. Cl.[7] ..... B65B 43/26; B65B 51/32
(52) U.S. Cl. ..... 53/570; 53/567; 53/375.3
(58) Field of Search ..... 53/567, 570, 375.3, 53/389.2

(56) References Cited

U.S. PATENT DOCUMENTS 4,510,736 A * 4/1985 Muller ..... 53/567
4,532,753 A * 8/1985 Kovacs ..... 53/375.3
4,873,815 A * 10/1989 Tetenborg ..... 53/570
5,179,815 A * 1/1993 Cahill ..... 53/389.2
5,448,879 A * 9/1995 Concetti ..... 53/570
5,626,004 A * 5/1997 Gates ..... 53/389.2
5,983,597 A * 11/1999 Venturi ..... 53/389.2

FOREIGN PATENT DOCUMENTS

| | | |
|---|---|---|
| DE | 24 18 228 | 10/1975 |
| DE | 31 18 866 | 12/1982 |
| DE | 42 13 387 | 10/1992 |
| EP | 0 468 376 | 1/1992 |
| EP | 0 844 175 | 5/1998 |

* cited by examiner

*Primary Examiner*—John Sipos
(74) *Attorney, Agent, or Firm*—Jacobson Holman, PLLC

(57) ABSTRACT

A device for manufacturing, filling and sealing thermoplastic sacks comprises a station, which comprises a forward draw unit for intermittently pulling forward a web of thermoplastic blown film and for its suspended feed in a vertical direction through a cross welding and cross severing mechanism, which provides the leading end of the blown film web with a cross weld and severs from said web a tubular segment above a gripping and transport mechanism. In order to pass the leading end of the blown film web quickly and without limply withdrawing to one side through the cross weld and cross severing mechanism into a stretched hanging position, there is a wall parallel to the feed path of the blown film web, and above the wall there are in its top region blowing air nozzles, facing the feed direction, between the wall and the feed path.

20 Claims, 4 Drawing Sheets

DEVICE FOR MANUFACTURING AND PREFERABLY ALSO FOR FILLING AND SEALING THERMOPLASTIC SACKS

BACKGROUND OF THE INVENTION

1. Field of the Invention

The invention relates to a device for manufacturing and preferably also for filling and sealing thermoplastic sacks. This device comprises a forward draw unit for intermittently pulling forward a thermoplastic blown film web and for its hanging feed in a vertical direction through a cross welding and cross severing mechanism, which provides the leading end of the blown film web with a cross weld and severs from said web a tubular segment above a gripping and transport mechanism.

2. Description of the Related Art

This class of device is known from the prior art in different designs. They serve the purpose of providing tubular segments with bottom welds. Preceding this step, the tubular segments were severed from a blown film web, which was wound on a supply roller. Then the welded tubular segments are filled with loose material; and the filled sacks are sealed with head welds and transported away. It is the desire of manufacturers to make such machines work more efficiently, i.e. at a high cycle rate. The output of such machines is also limited due to the fact that the leading end of the plastic web, provided with a bottom weld, must be passed in such a manner through the welding jaws, executing the bottom weld, and the cross cutter that the web is stretched. Furthermore, the freshly formed bottom weld must cool down in order to solidify before the segment, which was severed from the blown film web and now forms the a sack, can be filled with loose material. Pushing the leading end of the blown film web, provided with the bottom weld, in the direction of the transport plane of the sacks to be filled causes the problem that the freely advanced end segment tries to turn aside due to its limpness. Hence, it can move crossways and escape so that it takes additional time until the tubular segment to be severed has assumed its correct vertically hanging position.

SUMMARY OF THE INVENTION

Therefore, the object of the invention is to provide a device of the class described above, in which the leading end of the blown film web can be pushed quickly and without limply withdrawing to one side through the cross weld and cross severing mechanism into a stretched hanging position, in which the end sided bottom weld is in the area of the transport plane of the sacks to be filled.

The invention solves this problem in that there is a wall parallel to the feed path of the blown film web, and above the wall or in its top region there are blowing air nozzles, facing the feed direction, between the wall and the feed path.

The blowing air, blown through the blowing air nozzles into the gap between the web and the advanced end of the blown film web, flows in essence laminarly in the feed direction and takes with it the advancing end of the blown film web so that said web is stretched. In this manner a vacuum, which prevents the undesired flapping and turning aside of the fed in end of the blown film web, is generated between the blown film web and the wall. Preferably the blowing air nozzles comprise a row of blowing air nozzles or a elongated nozzle slit.

The blowing air, which serves to feed the end of the blown film web so as to be stretched, also cools the bottom weld.

However, to reduce the cycle period for producing and filling the sacks even more, it is desirable to cool the bottom weld so that it will solidify even faster. Therefore, another embodiment of the invention provides that the end region of the feed path has jaws that cool the bottom weld. These jaws can comprise a stationary jaw and a jaw that interacts with the stationary jaw and can be swung like pliers.

Preferably at least one of the jaws is provided with blowing air nozzles aimed at the bottom weld. Preferably both jaws exhibits rows of blowing air nozzles that are aimed at the bottom weld. The jaws clamp the bottom weld preferably not between their jaws in order to prevent the jaws from adhering to said weld.

In devices of the kind disclosed in the invention, sacks of different sizes and length are usually produced and filled. Therefore, it is necessary to change the distance between the cross weld and cross cutting mechanism and the transport plane of the sacks to be filled and to adjust the distance to the varying lengths of the sacks. Therefore, the jaws that serve the cooling process are mounted expediently on the support of a conveyor belt that carries away the filled sacks and that is mounted and guided in the machine frame so that it can be raised and lowered in accordance with the change in size.

The pliers holding the severed sacks can be moved preferably transversely or swung relative to the machine frame so that they can convey the severed sacks by one station length in the direction of the fill station.

Preferably there is a second pair of cooling jaws, of which at least one jaw is cooled and which are spaced one station away from the cooling jaws. Preferably this second pair of cooling jaws is also fastened to the support of the conveyor belt or to a bracket connected to said support.

An especially preferred embodiment of the invention provides that the length of the wall can be adjusted to the height of the support of the conveyor belt, thus to the changed sack size.

To make the adjustment to the different sack sizes, the wall can be made of a flexible web, whose bottom end is fastened to the support or to a bracket connected to said support. In this respect the web is looped between an upper deflecting rod or deflecting edge and an attachment of its other end to the machine frame; and a weight, e.g. a rod, is inserted into the loop. When the support of the conveyor belt moves, the wall adjusts itself automatically to the different sizes in that the wall elongating web segments are pulled out of the loop or wall shortening web segments are pulled into the loop.

To make the adjustment to the different sizes, the wall can also comprise overlapping wall sections, of which the top section is fastened rigidly to the frame and the bottom section is fastened to the support. In this embodiment the wall sections are made of a rigid material.

BRIEF DESCRIPTION OF THE DRAWINGS

One embodiment of the invention is explained in detail with the reference to the drawings.

DETAILED DESCRIPTION OF THE PREFERRED EMBODIMENTS

Figure 1:
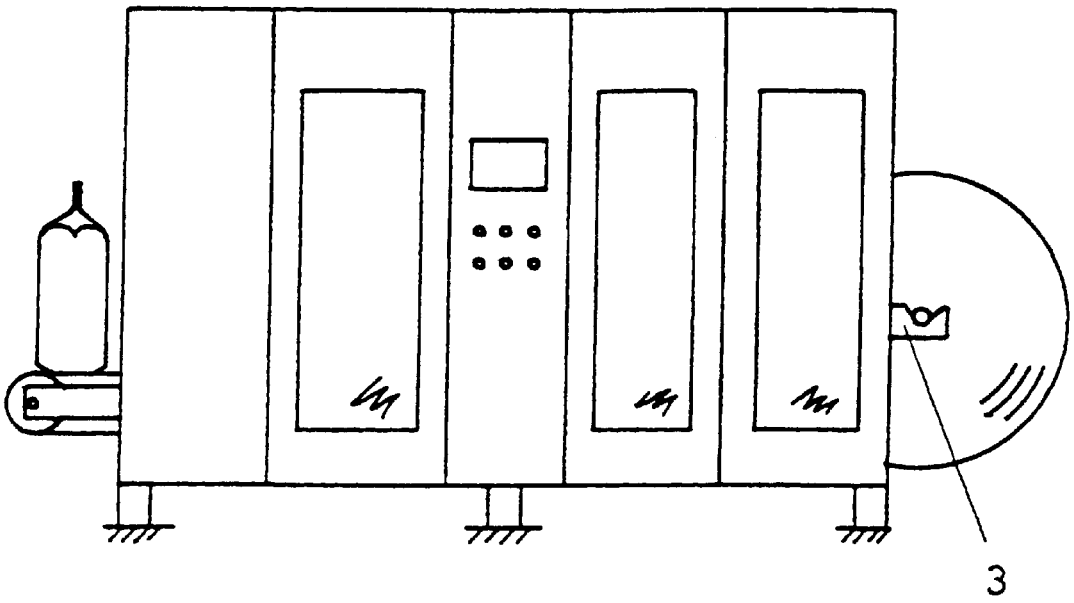
FIG. 1 is a side view of the device.
Figure 2:
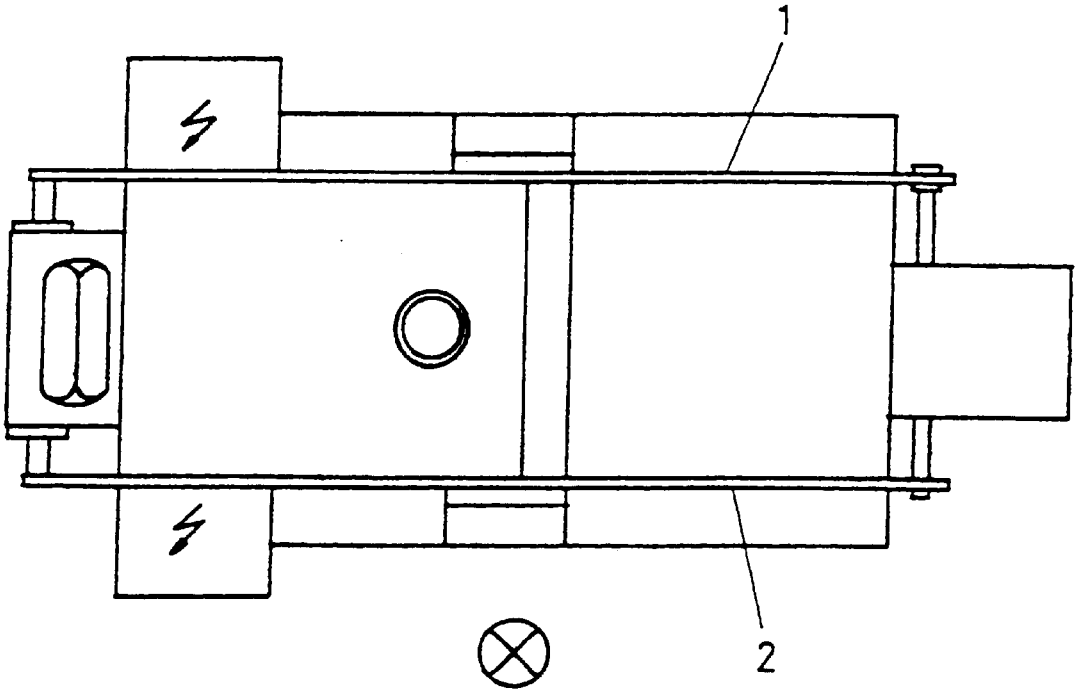
FIG. 2 is a top view of the device.
Figure 3:
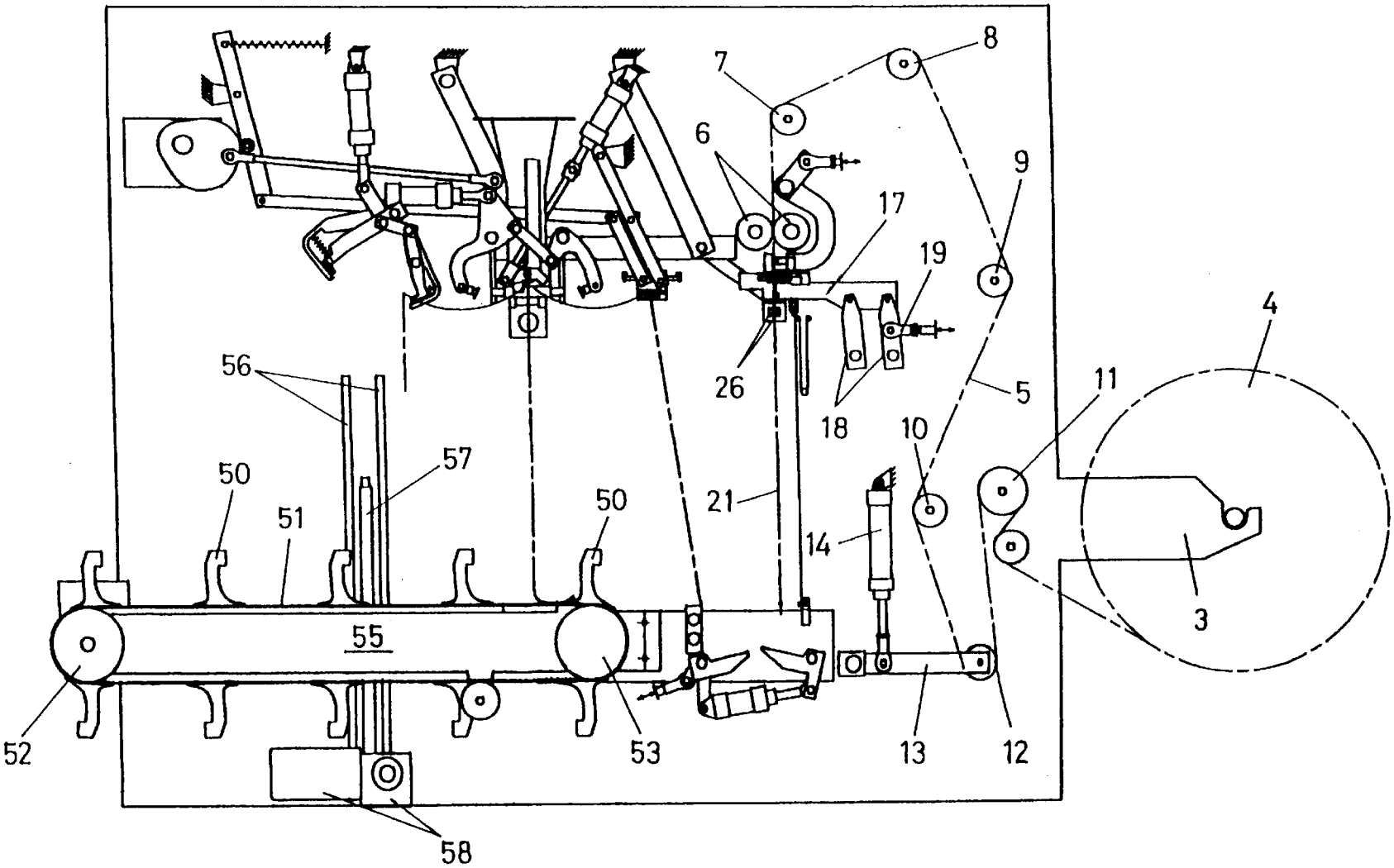
FIG. 3 is a schematic drawing of a side view of the device with its front wall removed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The device shown in the drawings for producing, filling, sealing and transporting away thermoplastic sacks comprises a machine with a relatively short overall length. All of the processing stations are arranged in one single machine frame.

The machine frame comprises two side members 1, 2, which are connected together with conventional traverses (not illustrated). The machine frame is encased with plates, doors and windows, so that it looks attractive. One end of the machine frame exhibits on the side members 1, 2 an unwinding unit 3 for the thermoplastic blown film web, wound into a supply roll. A blown film roller 4 is cradled in said unwinding unit. The blown film web 5, hauled off the blown film roller 4, is pulled forward at a given cycle rate over deflecting rollers by a pair of forward draw rollers 6. Between the deflecting or guide rollers 10, 11 the blown film web, hauled off the supply roller 4, is pulled by a pendulum roller 12 into a web loop, which forms a web storage. The blown film web, which is pulled forward at a given cycle rate, is hauled off the web storage, which fills again in the standstill phases of the blown film web in that the pendulum roller 12 draws such a large segment from the supply roller 4 that the loop obtains again its length, storing the segment length. The pendulum roller 12 is mounted between two levers 13, which are mounted on the machine frame and which are swung at a given cycle rate by a pneumatic cylinder 14 out of its swung in state into its illustrated swung out state.

The pair of forward draw rollers 6 pulls the blown film web 5, flowing off the deflecting roller 7, out into a vertical direction and pushes it between a cross welding and cross severing mechanism 15. This cross welding and cross severing station comprises a frame mounted jaw 16 and a swivelable jaw 17, which is carried by guide arms 18 that are mounted stationarily on the frame and can be swung back and forth by a rod 19, which is provided with a drive and hinged to a guide arm 18. The top part of the jaws 16, 17 is designed as the welding jaws executing the bottom welds. Below the welding jaws the stationary jaw 16 is provided with a groove and the swivelable jaw is provided with a cutting blade 20, which drops into the groove in synchronism with the tubular segments 21 to be cut off.

Preferably the blown film web is provided with side folds.

Mounted on guide arms 22, 23, which are attached rigidly to the frame, is a support 24, which forms a four joint system, thus a coupling. This support is connected to an inclined bracket 25, to whose side below the opening rims of the tubular segments 21 there are gripping pliers 26, which are indicated by the illustrated gripping jaws. Hinged to the guiding arm 23 is a connecting rod 27, which can be moved back and forth by a crank 29, driven by a gear motor 28. In so doing, the swivel motion of the support 24 is so large that the gripping pliers 26, enclosing the sack segment 21 below the cross welding and cross severing mechanism, move the sack segment by one station length along the arc 30 into a delivery station 31, where the gripping pliers 26 deliver the sack section to grippers 32, which grasp the opening rims from the top and convey the sack segment 21 to the filling station 33. The grippers 32 are carried by levers 34, 35, both of which are hinged to a thrust rod 36 and form with their hinged points on the thrust rod and the grippers a four joint system. The lever 35 is a two armed lever, whose top lever arm 37 is mounted rigidly on the frame in the manner illustrated. The thrust rod 36 is hinged to a two armed lever 38, which is mounted stationarily on the frame and whose top lever arm is loaded by a return spring 39 in the manner illustrated. The crank 29 is designed in the illustrated manner as a cam plate. A cam roller 40, which is mounted on the lower lever arm of the two armed lever 37, rolls down this cam disk. The thrust rod 36 is driven in such a manner by its cam plate—lever—cam roller drive that the grippers 32 advance and transfer the sack segment to holding grippers, which grasps below the fill funnel 42 on the side of the opening areas of the sack segments. On the support 24 there is a second pair of grippers 43 that passes the opening rims of the filled sack that are pulled tight again, after filling, to a welding station 34, where welding jaws (not illustrated) seal the tightly pulled opening rims of the sack with a cross weld.

Below the filling station 33 there is a conveyor belt 51, which is provided with posts 50 and which runs over one sided drive and deflecting rollers 52, 53 and which conveys the filled sacks 54 away from the filling and welding stations in synchronism with their filling. The drive and deflecting rollers 52, 53 of the conveyor belt 51 are mounted on the ends of a horizontal support 55, which can be raised and lowered by a spindle drive 57 in guides 56, which are fastened to the frame. In this respect the spindle drive 57 can be driven by means of a gear motor 58.

Figure 4:
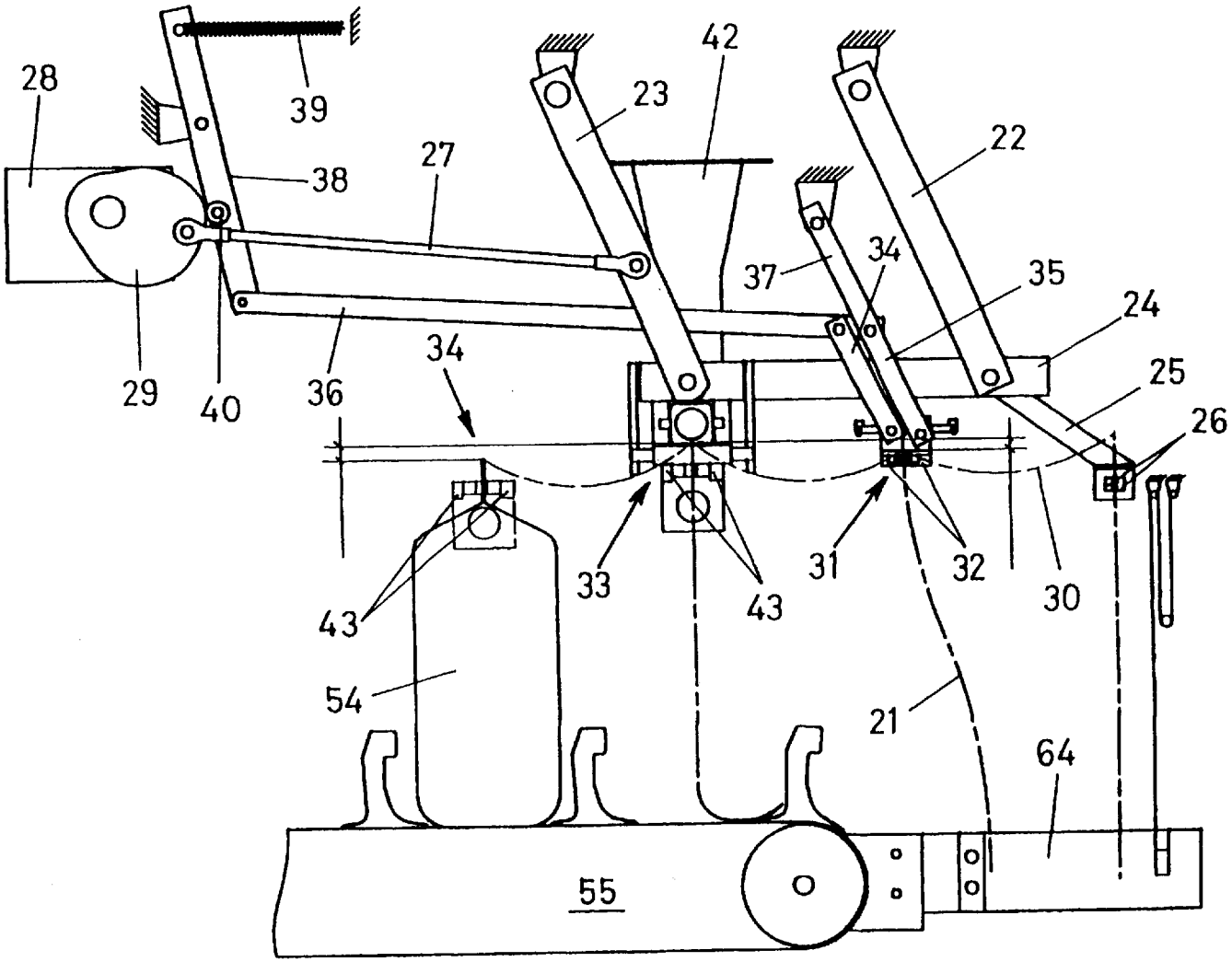
FIG. 4 is an enlarged view from FIG. 3 of the gripping pliers carrying away the sack segments at a given cycle rate.
Figure 5:
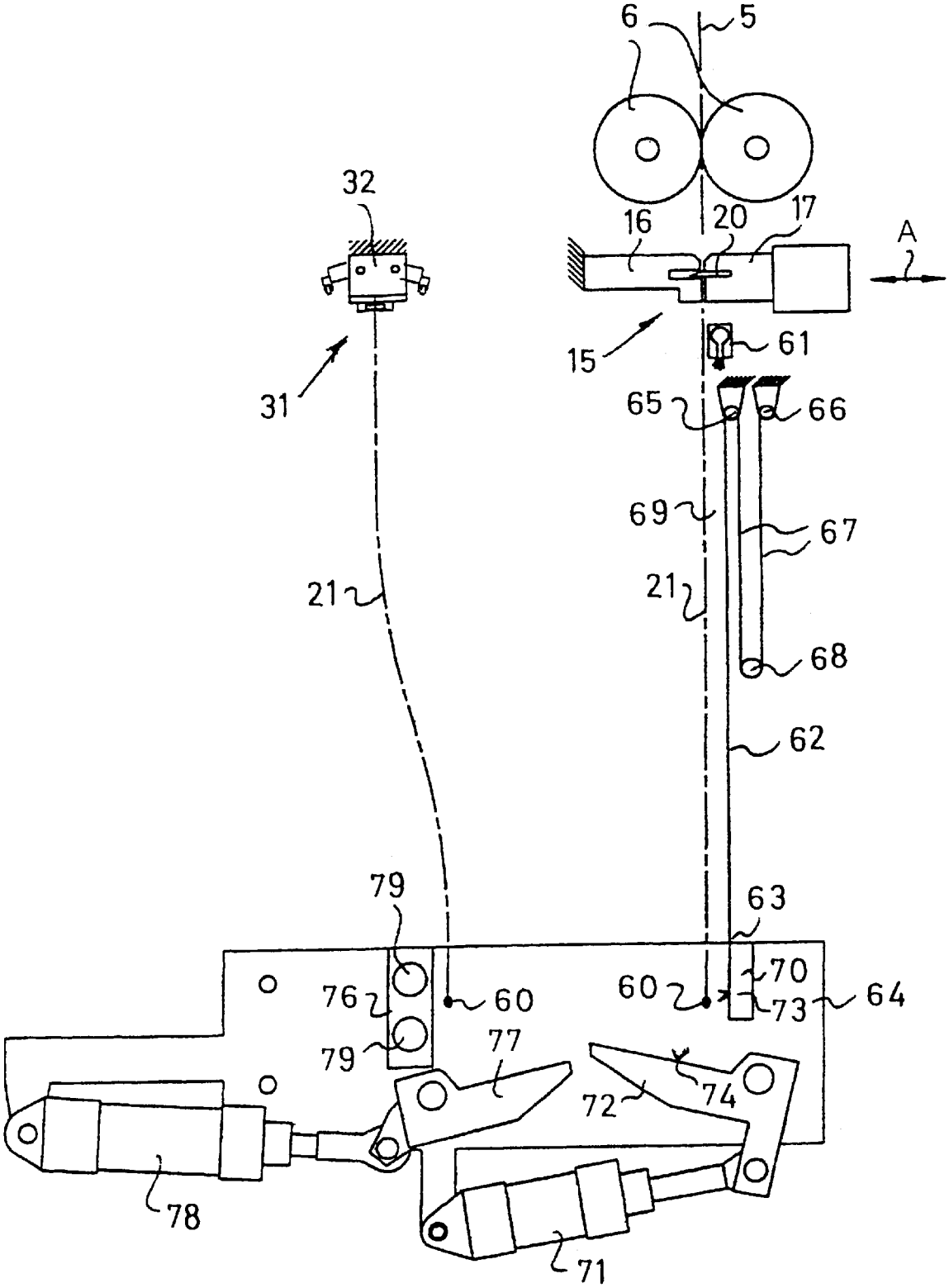
FIG. 5 is an enlarged view of the jaws cooling the bottom weld.

At this point the procedure for lowering the leading end of the blown film web 5, which is provided with a bottom weld 60, without flapping freely will be described in detail with reference to FIG. 5. While the blown film web 5 is fed intermittently through the cross weld and cross cutting mechanism 15, the jaw 17, which can be swung back and forth in the direction of the arrow A, is raised by the jaw 16, fastened rigidly to the frame. Below the jaw 17 in the machine frame there is a blowing air nozzle slit or a row of blowing air nozzles 61, whose blowing air current is aimed vertically toward the bottom. Parallel to the feed path for the blown film web 5 or the sack segments 21, severed from it, there is in the machine frame a wall 62, which comprises a taut web of film or fabric. The lower end 63 of the web 62 is connected to the brackets 64, which are connected to the support 55 of the conveyor belt 51 in the manner shown in FIG. 4. The web 62 travels from its bottom attachment 63 via a top deflecting rod 65, which is fastened rigidly to the frame, to its attachment 66, which is fastened rigidly to the frame. Between the deflecting rod 65 and its attachment 66 the web 62 is pulled out so as to form a loop 67. Inserted into the loop is a rod 68, which holds the web 62 taut. If for the sake of adjustment the support 55 of the conveyor belt 51 is moved upwardly, the taut section 62 of the web adapts automatically to the size change of the sack so that the required length of web is pulled out of the loop 67 or moves into said loop.

A slit of suitable width 69 is formed between the wall, comprising the taut film web 62, and the web segment 5, fed by the forward draw rollers 6. Above the wall 62 there are the blowing nozzles 61 or a blowing nozzle slit, from which blowing air is blown in the feed direction of the leading web segment 5 into the slit 69. Due to the constriction in the slit the blowing air becomes laminar. This laminar flow exerts a suction effect on the leading web segment and thus prevents it from flapping and turning aside. Owing to the effect of the blowing air current 61, which makes the web taut and attracts it through suction, the leading blown film segment 5 descends in the direction of the bracket 64 at a rate, specified by the pair of forward draw rollers 6.

As soon as the front end of the blown film web 5 has dropped and is now in the region of the cooling jaws 70, the pneumatic cylinder 71, which is pivot mounted on the bracket 64, swings the jaw 72 in the direction of the stationary jaw 70. Both jaws 70, 72 are provided with blowing air nozzles 73, 74, which blow cooling air on the weld 60. In so doing, the jaw 72 approaches the stationary jaw 70 only to the extent that both jaws do not touch the weld 60, thus preventing the jaws from adhering to said weld.

As soon as the segment 21 has been pushed in a taut state through the cross weld and cross cutting mechanism 15, the grippers 26 grasp the segment on the side below the top opening rim, so that then the segment 21 is severed. At the same time the cross weld can be affixed to the freshly formed end of the blown film web 5. The gripping pliers 26 convey the top segment end one station further so that in the delivery station 31 the pliers 32, grasping from the top, can take over the segment. Through this transfer stroke the tubular segment is conveyed into the position, which is shown on the left in FIG. 5 and where the weld 60 stops before a stationary jaw 76. This stationary jaw 76 is assigned a swivelable jaw 77, which is swung against the stationary jaw 76 in synchronism with the machine by a pneumatic cylinder 78. The stationary jaw 76 is penetrated by channels 79, through which cooling air flows. During the short residence period of the sack segment 21 in the delivery station 31 the weld 60 continues to cool as the weld 60 is clamped between the jaws 76, 77.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A device for manufacturing thermoplastic sacks, comprising:

a forward draw unit for intermittently pulling forward a thermoplastic blown film web and for a hanging feed of said blown film web in a vertical direction through a cross welding and cross severing mechanism which provides a leading end of the blown film web with a bottom weld and severs from said web a tubular segment above a gripping and transport mechanism, said tubular segment directed after said cross severing mechanism into a substantially vertical feed path;

a wall substantially parallel to said feed path of said blown film web tubular segment;

a cooling device located in a bottom end region of said feed path for cooling said bottom weld, said cooling device including a first pair of jaws, at least one of said jaws being pivotable to swing toward said bottom weld;

an air nozzle element located in an upper region of said feed path for blowing air downwardly in-between said wall and said feed path to assist downward movement of said tubular segment; to said cooling device.

2. The device as set forth in claim 1, wherein at least one of said jaws is provided with blowing air nozzles aimed at said bottom weld.

3. The device as set forth in claim 1, wherein said jaws include a swinging jaw and a stationary jaw, each of said jaws being provided with a blowing air nozzle aimed at said bottom weld, a pneumatic cylinder acting to swing said pivoting jaw toward said stationary jaw for cooling said weld without contact therewith.

4. The device as set forth in claim 1, wherein said jaws are mounted on a support of a conveyor belt that carries away filled sacks.

5. The device as set forth in claim 4, wherein a height of said support can be raised and lowered.

6. The device as set forth in claim 1, wherein said gripping and transport mechanism includes a set of grippers that grip the tubular segment and when moved laterally convey said tubular segment by one station length to a delivery station.

7. The device as set forth in claim 6, wherein said delivery station includes a second pair of cooling jaws, at least one of said second pair of jaws cooling said weld.

8. The device as set forth in claim 7, wherein said second pair of cooling jaws are fastened to a bracket connected to the support of the conveyor belt.

9. The device as set forth in claim 5, wherein a length of said wall is adjustable to accommodate the height of said support.

10. The device as set forth in claim 1, wherein said wall comprises overlapping wall sections, an upper section fastened rigidly to a frame of the device and a bottom section fastened to said support.

11. The device as set forth in claim 1, wherein said wall is a flexible web having a bottom end fastened to the support and an attachment at an upper end to a frame of said device, said web being laid into a loop between said attachment and an upper deflecting rod with a weight being inserted in said loop.

12. The device as set forth in claim 11, wherein said bottom end is fastened to said support through a bracket.

13. The device as set forth in claim 11, wherein said weight is a rod.

14. A device for manufacturing thermoplastic sacks and for moving said sacks on a conveyor belt, comprising:

a forward draw unit for intermittently pulling forward a thermoplastic blown film web and for a hanging feed of said blown film web in a vertical direction through a cross welding and cross severing mechanism which provides a leading end of the blown film web with a bottom weld and severs from said web a tubular segment above a gripping and transport mechanism, said tubular segment directed after said cross severing mechanism into a substantially vertical feed path;

a wall substantially parallel to said feed path of said blown film web, said wall being a flexible web having a bottom end fastened to a support of said conveyor belt and an attachment at an upper end to a frame of said device, said web being laid into a loop between said attachment and an upper deflecting rod with a weight inserted in said loop; and an air nozzle element located in an upper region of said feed path for blowing air downwardly in-between said wall and said path to assist downward movement of said tubular segment.

15. The device as set forth in claim 14, wherein said weight is a rod.

16. The device as set forth in claim 14, and further comprising a cooling device located in a bottom end region of said feed path for cooling said bottom weld, said cooling device including a first pair of jaws, at least one of said jaws being pivotable to swing and approach said bottom weld.

17. The device as set forth in claim 16, wherein at least one of said jaws is provided with blowing air nozzles aimed at said bottom weld.

18. The device as set forth in claim 14, wherein said gripping and transport mechanism includes a set of grippers that grip the tubular segment and when moved laterally convey said tubular segment by one station length to a delivery station.

19. The device as set forth in claim 18, wherein said delivery station includes a second pair of cooling jaws, at least one of said second pair of jaws being cooled.

20. The device as set forth in claim 16, wherein each of said jaws is provided with a blowing air nozzle aimed at said bottom weld for cooling said weld without contact therewith.

* * * * *